United States Patent [19]

Sprintschnik et al.

[11] Patent Number: 4,566,952

[45] Date of Patent: Jan. 28, 1986

[54] TWO-STAGE PROCESS FOR THE PRODUCTION OF ANODICALLY OXIDIZED ALUMINUM PLANAR MATERIALS AND USE OF THESE MATERIALS IN MANUFACTURING OFFSET-PRINTING PLATES

[75] Inventors: Gerhard Sprintschnik, Taunusstein; Walter Niderstätter, Eltville; Joachim Stroszynski, Wiesbaden-Naurod, all of Fed. Rep. of Germany

[73] Assignee: Hoechst Aktiengesellschaft, Frankfurt am Main, Fed. Rep. of Germany

[21] Appl. No.: 595,538

[22] Filed: Mar. 30, 1984

[30] Foreign Application Priority Data

Apr. 7, 1983 [DE] Fed. Rep. of Germany ..... 3312497

[51] Int. Cl.[4] ..... C25D 11/08; C25D 11/12; C25D 11/16; C25D 11/18

[52] U.S. Cl. ..... 204/27; 204/28; 204/33; 204/37.6; 204/38.3; 204/58

[58] Field of Search ..... 204/17, 33, 37.6, 38 A, 204/38 E, 58, 129.1, 27, 28, 38.3, 38.7

[56] References Cited

U.S. PATENT DOCUMENTS

| | | | |
|---|---|---|---|
| 3,511,661 | 5/1970 | Rauner et al. | 96/86 |
| 3,594,289 | 7/1971 | Watkinson et al. | 204/38 A |
| 3,940,321 | 2/1976 | Adams | 204/58 |
| 4,211,619 | 7/1980 | Usbeck | 204/33 |
| 4,229,266 | 10/1980 | Usbeck | 204/33 |

FOREIGN PATENT DOCUMENTS

| | | | |
|---|---|---|---|
| 0007233 | 4/1982 | European Pat. Off. | 240/58 |
| 0007234 | 4/1982 | European Pat. Off. | 204/58 |
| 1401067 | 7/1975 | United Kingdom | 204/37.6 |
| 1410768 | 10/1975 | United Kingdom | 204/37.6 |
| 1495861 | 12/1977 | United Kingdom | 204/38 E |
| 2088901 | 6/1982 | United Kingdom | 204/58 |

*Primary Examiner*—T. M. Tufariello

*Attorney, Agent, or Firm*—Schwartz, Jeffery, Schwaab, Mack, Blumenthal & Evans

[57] ABSTRACT

Disclosed is a process for the production of a material in the form of a plate, a foil or a strip, from aluminum or an alloy thereof, which has been chemically, mechanically and/or electrochemically roughened. The process comprises a two-stage oxidation involving a first stage (a) which is performed in an aqueous electrolyte having from about 60 to 180 g/l of phosphoric acid, at a temperature of the electrolyte bath of about 47° to 70° C. and at a voltage of about 36 to 80 V and a second stage (b) which is performed in an aqueous electrolyte having from about 60 to 300 g/l of sulfuric acid, at a temperature of the electrolyte bath of about 30° to 65° C. and at a voltage of about 15 to 35 V. Also disclosed is an offset-printing plate, having a radiation-sensitive coating and a support material produced by the process described above.

17 Claims, No Drawings

TWO-STAGE PROCESS FOR THE PRODUCTION OF ANODICALLY OXIDIZED ALUMINUM PLANAR MATERIALS AND USE OF THESE MATERIALS IN MANUFACTURING OFFSET-PRINTING PLATES

BACKGROUND OF THE INVENTION

The present invention relates to a two-stage anodic oxidation process for aluminum which is particularly employed as a support material for offset-printing plates.

Support materials for offset-printing plates are provided, on one or both sides, with a radiation-sensitive (photosensitive) coating (reproduction coating), which is applied either directly by the user or by the manufacturer of precoated printing plates and with the aid of which a printing image of an original is produced by a photomechanical method. Following the production of a printing form of this type from the printing plate, the coating support comprises image areas which are ink-receptive in the subsequent printing process. Simultaneous with the image-production, a hydrophilic image-background for the lithographic printing operation is formed in the areas which are free from an image (non-image areas) in the subsequent printing process.

A coating support for reproduction coatings used in the manufacture of offset-printing plates must meet the following requirements:

Those portions of the radiation-sensitive coating, which are comparatively more soluble following exposure must be capable of being easily removed from the support by a developing operation, in order to produce the hydrophilic non-image areas without leaving a residue and without any stronger attack on the support material by the developer.

The support, which has been laid bare in the non-image areas, must possess a high affinity for water, i.e., it must be strongly hydrophilic, in order to accept water, rapidly and permanently, during the lithographic printing operation, and to exert an adequate repelling effect with respect to the greasy printing ink.

The radiation-sensitive coating must exhibit an adequate degree of adhesion prior to exposure, and those portions of the coating which print must exhibit adequate adhesion following exposure.

The support material should possess good mechanical stability, for example with respect to abrasion, and good chemical resistance, especially with respect to alkaline media.

As the base material for coating supports of this kind, aluminum is particularly frequently used, the surface of this aluminum being roughened, according to known methods, for example, by dry-brushing, slurry-brushing, sandblasting, or by chemical and/or electrochemical treatments. In order to increase the resistance to abrasion, electrochemically roughened substrates, especially, are additionally subjected to an anodizing step, in order to build up a thin oxide layer. These anodic oxidation processes are conventionally carried out in aqueous electrolytes which contain $H_2SO_4$, $H_3PO_4$, $H_2C_2O_4$, $H_3BO_3$, amidosulfonic acid, sulfosuccinic acid, sulfosalicylic acid or mixtures thereof. The oxide layers built up in these aqueous electrolytes or electrolyte mixtures differ from one another in structure, layer thickness and resistance to chemicals. Roughened and anodically oxidized materials of this type also are of some importance in other technical fields, for example, in electrolytic capacitors or in the building industry. Aqueous solutions of $H_2SO_4$ and/or $H_3PO_4$ are particularly used in the commercial production of supports for offset-printing plates.

By way of example, the following standard methods are representative of the use of aqueous electrolytes containing $H_2SO_4$ for the anodic oxidation of aluminum (see, in this regard, e.g., M. Schenk, Werkstoff Aluminium und seine anodische Oxydation (The Material Aluminum and its Anodic Oxidation), Francke Verlag, Bern, 1948, page 760; Praktische Galvanotechnik (Practical Electroplating), Eugen G. Leuze Verlag, Saulgau, 1970, pages 395 et seq., and pages 518/519; W. Huebner and C. T. Speiser, Die Praxis der anodischen Oxidation des Aluminiums (Practical Technology of the Anodic Oxidation of Aluminum), Aluminium Verlag, Duesseldorf, 1977, 3rd edition, pages 137 et seq.):

The direct current sulfuric acid process, in which anodic oxidation is carried out in an aqueous electrolyte which conventionally contains approximately 230 g of $H_2SO_4$ per 1 liter of solution, for 10 to 60 minutes at 10° to 22° C., and at a current density of 0.5 to 2.5 $A/dm^2$. In this process, the sulfuric acid concentration in the aqueous electrolyte solution can also be reduced to 8 to 10% by weight of $H_2SO_4$ (about 100 g of $H_2SO_4$ per liter), or it can also be increased to 30% by weight (365 g of $H_2SO_4$ per liter), or more.

The "hard-anodizing process" is carried out using an aqueous electrolyte, containing $H_2SO_4$ in a concentration of 166 g of $H_2SO_4$ per liter (or about 230 g of $H_2SO_4$ per liter), at an operating temperature of 0° to 5° C., and at a current density of 2 to 3 $A/dm^2$, for 30 to 200 minutes, at a voltage which rises from approximately 25 to 30 V at the beginning of the treatment, to approximately 40 to 100 V toward the end of the treatment.

In the anodic oxidation of aluminum support materials for printing plates, described in European Pat. No. 0,004,569 (=U.S. Pat. No. 4,211,619), an aqueous electrolyte is used which contains from 25 to 100 g/l of $H_2SO_4$ and the $Al^{3+}$ ion content of which is adjusted to values exceeding 10 g/l.

Aluminum oxide layers produced by these methods are amorphous and, in the case of offset-printing plates, conventionally have a layer weight of about 0.5 to 10 $g/m^2$, corresponding to a layer thickness of about 0.15 to 3.0/μm. When a support material which has been anodically oxidized in this way is used for offset-printing plates, it has the disadvantage that the oxide layers produced in $H_2SO_4$ electrolytes have a comparatively low resistance to alkaline solutions, such as are used to an increasing extent, for example, in the processing of pre-sensitized offset-printing plates, and preferably in up-to-date developing solutions for radiated negative-working or, in particular, positive-working radiation-sensitive coatings.

The anodic oxidation of aluminum in aqueous electrolytes containing phosphoric acid is also known, as discussed below.

German Auslegeschrift No. 1,671,614 (=U.S. Pat. No. 3,511,661) discloses a process for manufacturing a lithographic printing plate in which the aluminum support is anodically oxidized in an at least 10% strength aqueous solution of $H_3PO_4$, at a temperature of at least 17° C., until the layer of aluminum oxide has a thickness of at least 50 nm.

German Offenlegungsschrift No. 1,809,248 (=U.S. Pat. No. 3,594,289) discloses a process, in which an aluminum support material for printing plates is anodically oxidized for 2 to 10 minutes, in a 5 to 50% strength aqueous solution of $H_3PO_4$, at a current density of 0.5 to 2.0 A/dm$^2$ and a temperature of 15 to 40° C.

The anodic oxidation of aluminum support materials for printing plates, which is described in German Offenlegungsschrift No. 2,507,386 (=British Pat. No. 1,495,861) is carried out in a 1 to 20% strength aqueous solution of $H_3PO_4$ or of polyphosphoric acid at 10 to 40° C., using an alternating current at a current density of 1 to 5 A/dm$^2$ (1 to 50 V).

Although an oxide layer produced in phosphoric acid is frequently more stable with respect to alkaline media than an oxide layer which has been produced in an electrolyte based on a $H_2SO_4$ solution, and additionally exhibits a number of other advantages, such as lighter surface, better water/ink balance or low adsorption of dyes ("staining" in the non-image areas), it nevertheless also possesses significant disadvantages. The oxide-layer weights which can be produced in a modern strip-processing unit for the manufacture of printing-plate supports, using voltages and dwell times which are technically appropriate, range, for example, up to only approximately 1.5 g/m$^2$, a layer thickness which naturally offers less protection against mechanical abrasion than a thicker oxide layer, produced in a $H_2SO_4$ electrolyte. Due to the larger pore volume and pore diameter in an oxide layer which has been produced in $H_3PO_4$, the mechanical stability of the oxide itself is also lower, which results in further losses with regard to abrasion resistance.

Also, processes have already been disclosed which attempt to combine the advantages of the two electrolytes, by using electrolyte mixtures composed of $H_2SO_4$ and $H_3PO_4$ or employing a two-stage treatment procedure.

In the process for manufacturing aluminum support materials for printing plates, according to German Offenlegungsschrift No. 2,251,710 (=British Pat. No. 1,410,768), aluminum is first anodically oxidized in an electrolyte containing $H_2SO_4$, to form an oxide layer which is then post-treated in a 5 to 50% strength aqueous solution of $H_3PO_4$, without the action of an electrical current. The actual oxide layer is stated to possess a weight per unit area of 1 to 6 g/m$^2$, but a significant decrease of this weight, for example, by about 2 to 3 g/m$^2$ per minute of immersion time, occurs upon immersion in the aqueous $H_3PO_4$ solution. It is also stated that it is possible to perform an electrochemical treatment in the $H_3PO_4$ solution (Example 11) or to employ a mixed electrolyte composed of $H_3PO_4$ and $H_2SO_4$ (Example 12), the oxide layer being likewise reduced in these cases.

U.S. Pat. No. 3,940,321 also describes a two-stage anodic oxidation, first in an electrolyte based on $H_2SO_4$, and then in an electrolyte based on $H_3PO_4$, using a direct current at a voltage of 10 to 15 V (1 to 15 A/dm$^2$ current density) in both stages. The aqueous electrolytes which are employed contain, in the first stage, from 5 to 50% of acid and, in the second stage, from 20 to 60% of acid.

A mixed electrolyte composed of $H_2SO_4$ and $H_3PO_4$, which is used in the production of support materials for printing plates, is described in European Pat. No. 0,008,440 (=U.S. Pat. No. 4,229,226), in which a specific content of aluminum ions is additionally mentioned.

In European Pat. Nos. 0,007,233 and 0,007,234, aluminum support materials for printing plates are anodically oxidized by passing them, as center conductors, first through a bath containing a 45% strength aqueous $H_3PO_4$ solution and an anode and then into a bath containing a 15% strength aqueous $H_2SO_4$ solution and a cathode. The two electrodes can also be connected to a source of alternating voltage (in each case about 16 to 21 V, 2 A/dm$^2$). In the treatment with direct current, the first bath substantially serves for producing the electrical contact. In the treatment with alternating current, the respective half-wave, which results in the aluminum being made the anode, can effect an anodic oxidation already in the first bath.

British Patent Application No. 2,088,901 discloses a two-stage anodic oxidation process for aluminum support materials for printing plates, which uses, in the first stage, an aqueous electrolyte containing 250 to 400 g of $H_3PO_4$ per liter, for 15 to 240 seconds, at a voltage from 15 to 35 V and at a temperature from 15° to 46° C. and, in the second stage, an aqueous electrolyte containing 20 to 150 g of $H_2SO_4$ and 250 to 380 g of $H_3PO_4$ per liter, under the above-specified conditions. In particular, the voltage employed in the second stage should be higher than or equal to the voltage employed in the first stage; the voltage applied in the examples is invariably based on a direct-current source.

The processes with mixed electrolytes may effect (with increasing $H_3PO_4$ content) an approximation of the properties of the oxide layer to the properties obtained in an anodic oxidation in pure aqueous $H_3PO_4$ solutions, but they do not reach these properties. On the other hand, the positive properties of an anodic oxidation in pure aqueous $H_2SO_4$ solutions, e.g., thickness of oxide layer, abrasion-resistance, also decline. Moreover, a bath monitoring procedure (in the case of a solution containing several components) is very expensive in terms of production technology, and is difficult to control. The two-stage anodic oxidation or treatment method, leads to a situation wherein the oxide layer which has been built up in the $H_2SO_4$ electrolyte is redissolved in the $H_3PO_4$ solution to an excessive extent, under the conditions hitherto known. This is also the case with the prior art processes, in which this sequence of stages is reversed, particularly if an alternating current is used and due to the very high concentrations of $H_3PO_4$ in the electrolyte. In the process variant which employs an acid mixture composed of $H_3PO_4$ and $H_2SO_4$ in the second stage, problems with bath-monitoring are again encountered. Moreover, the process variant using a single circuit for the two stages can be disadvantageous, since it is more difficult to control from the point of view of production engineering.

SUMMARY OF THE INVENTION

It is therefore an object of the present invention to provide an improved process for the anodic oxidation of roughened planar aluminum, in particular of support materials for offset-printing plates.

It is an additional object of the present invention to provide an improved anodic oxidation process which can be performed relatively quickly and without great expenditure, in a modern strip-processing unit.

A further object is the provision of a process in which the amount of oxide-redissolution is small or nonexistent.

A still further object of the present invention is the provision of a process which maintains the positive oxide layer properties of anodic oxidations in aqueous solutions of $H_3PO_4$ or $H_2SO_4$.

Therefore, in accordance with one aspect of the present invention, there is provided a process for producing an aluminum or aluminum alloy material in the form of a plate, foil or strip, comprising the step of anodically oxidizing a support material in a two-stage oxidation process comprising the steps of (a) first treating the support material in an aqueous electrolyte comprising from about 60 to 180 g/l of phosphoric acid, at a temperature of from about 47° to 70° C. and a voltage of from about 36 to 80 V, and (b) subsequently treating the support material in an aqueous electrolyte comprising from about 60 to 300 g/l of sulfuric acid, at a temperature of from about 30° to 65° C. and a voltage of from about 15 to 35 V.

In another aspect of the present invention, there is provided an anodically oxidized support material for offset-printing plates produced by the process described above.

In preferred embodiments, the first treating step is performed in an aqueous electrolyte having from about 80 to 150 g/l of phosphoric acid, at a bath temperature from about 50° to 65° C. and at a voltage of from about 40 to 70 V, and the second treating step is performed in an aqueous electrolyte having from about 80 to 250 g/l of sulfuric acid, at a bath temperature of from about 40° to 60° C. and at a voltage of from about 20 to 30 V. The aqueous electrolytes employed in each case preferably should not contain any other types of acids, since it is then more difficult to adjust and control the compositions of the baths and to obtain stable product properties, in modern high-speed units. Generally, however, the two electrolytes additionally contain $Al^{3+}$ ions, which are added in the beginning in the form of a salt (as a sulfate or phosphate) and/or which are formed in the procedure. The components which differ from the respective acid, and other than water which is present as the basic solvent, should, if possible, not exceed a maximum of about 30 g/l in stage (a) and a maximum of about 50 g/l in stage (b).

Further objects, features and advantages of the present invention will become apparent from the detailed description of preferred embodiments which follows.

DETAILED DESCRIPTION OF PREFERRED EMBODIMENTS

The present invention is based on a process for the production of a material in the form of a plate, a foil or a strip, from aluminum or an alloy thereof, which usually has been chemically, mechanically and/or electrochemically roughened. The process comprises a two-stage anodic oxidation in (a) an aqueous electrolyte containing phosphoric acid and, thereafter, in (b) an aqueous electrolyte containing sulfuric acid. In the process according to the invention, stage (a) is carried out in an aqueous electrolyte having from about 60 to 180 g/l of phosphoric acid, at a temperature of the bath of about 47° to 70° C. and at a voltage of about 36 to 80 V and stage (b) is carried out in an aqueous electrolyte having from about 60 to 300 g/l of sulfuric acid, at a temperature of the bath of about 30° to 65° C. and at a voltage of about 15 to 35 V. The process can be discontinuously or, in particular, continuously conducted.

Suitable base materials for the material which is to be oxidized according to the present invention include those of aluminum or an alloy thereof, which contains, for example, more than 98.5% by weight of Al, with Si, Fe, Ti, Cu and Zn as constituents. After an optional precleaning, these aluminum-support materials are roughened mechanically, e.g., by brushing and/or abrasive treatment; chemically, e.g., by etchants; and/or electrochemically, e.g., by treating with an alternating current in aqueous HCl, $HNO_3$ or salt solutions. In the process of the invention, materials which have been subjected to electrochemical roughening or to a combination of mechanical and electrochemical roughening are especially preferred.

The process parameters in the roughening stage, particularly in a continuous procedure, are generally within the following ranges: temperature of the electrolyte between about 20° and 60° C., concentration of active substance (acid, salt) between about 2 and 100 g/l, or even higher in the case of salts, current density between about 15 and 250 A/dm$^2$, dwell time between about 3 and 100 seconds and flow rate of the electrolyte measured on the surface of the workpiece to be treated between about 5 and 100 cm/second. The type of current used is in most cases alternating current; however, it is also possible to use modified current types, e.g., an alternating current with different amplitudes of current strength for the anode and cathode current. The mean peak-to-valley roughness $R_z$ of the roughened surface is in the range from about 1 to 15 μm. The peak-to-valley roughness is determined according to DIN 4768, October 1970 edition, the peak-to-valley rougheness $R_z$ then being the arithmetic mean calculated from the individual peak-to-valley roughnesses of five contiguous individual measurement lengths.

Pre-cleaning comprises, for example, treating the support material in an aqueous NaOH solution with or without a degreasing agent and/or complexing agents, trichloroethylene, acetone, methanol or other so-called aluminum pickles, which are commercially available. An abrasive treatment may additionally be performed after roughening or, in the case of several roughening stages, even between the individual stages. In the abrasive treatment at most 2 g/m$^2$ of material are removed per stage and up to 5 g/m$^2$ total. Generally used solutions having an abrading action include aqueous alkali-metal hydroxide solutions or aqueous solutions of salts which have an alkaline reaction or aqueous acid solutions based on $HNO_3$, $H_2SO_4$ or $H_3PO_4$. In addition to an abrading treatment stage between the roughening stage and the anodizing stages, non-electrochemical treatments are also known, which have a rinsing and/or cleaning action and serve, for example, to remove deposits ("smut") which have formed in the roughening procedure or simply to remove electrolyte residues. For these purposes, dilute aqueous alkali-metal hydroxide solutions or water, for example, are employed.

After the roughening process is completed, the aluminum support is further processed. A first anodic oxidation of the aluminum (stage a) is performed in an electrolyte containing $H_3PO_4$, of a type described previously, in the discussion of the prior art and as determined above in terms of specific parameters. A rinsing stage may be carried out prior to the second oxidation stage (stage b). Stage (b) is performed in an electrolyte containing $H_2SO_4$, of a type also previously described in the discussion of the prior art and as determined above in terms of specific parameters. For the anodic oxidation in these stages, a direct current is preferably used. It is, however, also possible to use an alternating current or a combination of these types of current, e.g., a direct current with a superimposed alternating current. In the two stages, the process time is preferably about 10 to 100 seconds. The layer weights of aluminum oxide range between about 0.5 and 10 g/m$^2$, corresponding to a layer thickness of about 0.15 to 3 μm. The aluminum oxide layers also contain $Al_2(SO_4)_3$ and $AlPO_4$.

The anodic-oxidation stages of the aluminum support material are optionally followed by one or more post-treating stages. Post-treating is particularly understood as a hydrophilizing treatment, either chemical or electrochemical, of the aluminum oxide layer, for example, an immersion treatment of the material in an aqueous solution of polyvinyl phosphonic acid, according to German Pat. No. 1,621,478 (=British Pat. No. 1,230,447), an immersion treatment in an aqueous solution of an alkali-metal silicate according to German Auslegeschrift No. 1,471,707 (=U.S. Pat. No. 3,181,461), or an electrochemical treatment (anodizing) in an aqueous solution of an alkali metal silicate according to German Offenlegungsschrift No. 2,532,769 (=U.S. Pat. No. 3,902,976). These post-treatment stages serve, in particular, to improve even further the hydrophilic character of the aluminum oxide layer, which is already sufficient for many fields of application, with the other well-known properties of the layer being at least maintained.

The materials produced according to the present invention are advantageously used as supports for offset-printing plates, i.e., a radiation-sensitive coating is applied to one or both sides of the support material, either by the manufacturer of presensitized printing plates or directly by the user. Suitable radiation-sensitive (photosensitive) coatings basically comprise any coatings which, after radiation (exposure), optionally followed by developing and/or fixing, yield a surface in image configuration, which can be used for printing.

In addition to the coatings containing silver halides, which are used in many fields, various other coatings are also known, such as those described, for example, in "Light-Sensitive Systems," by Jaromir Kosar, published by John Wiley & Sons, New York, 1965: Colloid coatings containing chromates and dichromates (Kosar, Chapter 2); coatings containing unsaturated compounds which, upon exposure, are isomerized, rearranged, cyclized, or crosslinked (Kosar, Chapter 4); coatings containing compounds which can be photopolymerized, which, upon exposure, undergo polymerization of the monomers or prepolymers, optionally with the aid of an initiator (Kosar, Chapter 5); and coatings containing o-diazoquinones, such as naphthoquinonediazides, p-diazoquinones, or condensation products of diazonium salts (Kosar, Chapter 7). Other suitable coatings include the electrophotographic coatings, i.e., coatings which contain an inorganic or organic photoconductor. In addition to the photosensitive substances, these coatings can, of course, also contain other constituents, such as for example, resins, dyes or plasticizers. In particular, the following photosensitive compositions or compounds can be employed in the coating of support materials prepared according to the process of the present invention:

positive-working reproduction coatings which contain, as the photosensitive compound, o-quinone diazides, particularly o-naphthoquinone diazides, for example, 1,2-naphthoquinone-2-diazide-sulfonic acid esters or amides, which may have low or higher molecular weights, as described, for example in German Pat. Nos. 854,890, 865,109, 879,203, 894,959, 938,233, 1,109,521, 1,144,705, 1,118,606, 1,120,273, 1,124,817 and 2,331,377 and in published European Patent Application Nos. 0,021,428 and 0,055,814;

negative-working reproduction coatings which contain condensation products from aromatic diazonium salts and compounds with active carbonyl groups, preferably condensation products formed from diphenylaminediazonium salts and formaldehyde, which are described, for example, in German Pat. Nos. 596,731, 1,138,399, 1,138,400, 1,138,401, 1,142,871, 1,154,123, U.S. Pat. Nos. 2,679,498, and 3,050,502 and British Pat. No. 712,606;

negative-working reproduction coatings which contain co-condensation products of aromatic diazonium compounds, for example, according to German Pat. No. 2,065,732 comprising products which possess, in each case, at least one unit of (a) an aromatic diazonium salt compound which is capable of condensation and (b) a compound, such as a phenol ether or an aromatic thioether, which is capable of condensation, connected by a bivalent intermediate member derived from a condensable carbonyl compound, for example, a methylene group;

positive-working coatings according to German Offenlegungsschrift No. 2,610,842, German Pat. No. 2,718,254 or German Offenlegungsschrift No. 2,928,636, which contain a compound which, on being irradiated, splits off an acid, a monomeric or polymeric compound which possesses at least one C—O—C group, which can be split off by acid, e.g., an orthocarboxylic acid ester group, or a carboxamide-acetal group, and, if appropriate, a binder;

negative-working coatings, composed of photopolymerizable monomers, photo-initiators, binders and, if appropriate, further additives, in these coatings, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschriften Nos. 2,064,079 and 2,361,041;

negative-working coatings according to German Offenlegungsschrift No. 3,036,077, which contain, as the photosensitive compound, a diazonium salt polycondensation product, or an organic azido compound, and which contain, as the binder, a high-molecular weight polymer with alkenylsulfonylurethane or cycloalkenylsulfonylurethane side groups.

It is also possible to apply photo-semiconducting coatings to the support materials manufactured according to the invention, such as described, for example, in German Pat. Nos. 1,117,391, 1,522,497, 1,572,312, 2,322,046 and 2,322,047, as a result of which highly photosensitive electrophotographically working printing plates are produced.

The coated offset-printing plates which are obtained from the support materials produced according to the invention are converted into the desired printing form, in a known manner, by imagewise exposure or irradiation, and rinsing of the non-image areas with a developer, preferably an aqueous developing solution.

The materials produced according to the present invention have the advantage that, compared with an oxide layer produced in an electrolyte which only contains $H_3PO_4$, the resistance of the materials to alkali is at least equivalent in terms of quality and, due to the greater layer thickness, is even rather superior in terms of quantity. The surface of the support material is lighter than in the case of a simple anodization in $H_2SO_4$-containing electrolytes leading to an improved contrast between image and non-image areas of the printing form. Staining and adsorption of dyes, which is frequently noticed after anodization in electrolytes which contain only $H_2SO_4$, does not occur on the support surfaces produced according to the present invention. There is, however, even a further improvement, in addition to a large print-run, which is observed in printing forms prepared from the materials. This advantage is evidenced when water-supply is reduced in the printing procedure. The non-image areas of a printing form having a support produced according to the present invention scum much later than those of a printing form having a support which has merely been anodically oxidized in a one-stage process using aqueous electrolytes which contain only $H_2SO_4$ or $H_3PO_4$. By completely interrupting water-supply until strong scumming occurs, a printing form produced according to the present invention, after re-applying water, becomes clean considerably more rapidly than the printing forms produced according to methods which differ from the method of this invention. The process according to the present invention, moreover, offers the advantage that anodic oxidation can be carried out without difficulty, even at high speeds of, for example, at least 40 to 50 m/min., without giving rise to any appreciable negative effect on the quality of the oxide layer.

The methods of characterizing the surface used in some of the following examples are described below.

In the measurement of abrasion, a friction wheel is passed over the surface of an uncoated plate section and the loss in mass of the surface is determined per unit area (based on a standard treatment time).

When the surface is tested for dye adsorption, a plate section provided with the radiation-sensitive coating is exposed and developed and then one-half of the plate is treated with a deletion fluid. The greater the difference, e.g., in color values, between the untreated and the treated half, the higher is the amount of dye adsorbed by the untreated surface of the support material.

In the following examples, parts by weight are related to parts by volume as kg to $dm^3$, and percentages relate to weight, unless otherwise indicated.

EXAMPLE 1

In a continuous procedure, an aluminum strip is first pre-treated in a 4% strength aqueous NaOH solution for 12 seconds at 60° C. and thereafter electrochemically roughened in an aqueous solution containing 1% of $HNO_3$ and 10% of $Al(NO_3)_3$, using an alternating current at a current density of 80 $A/dm^2$, for 25 seconds at 33° C. The two-stage anodic oxidation is performed first in a 10% strength aqueous $H_3PO_4$ solution for 25 seconds at 58° C. and at a voltage of 60 V and then in an aqueous $H_2SO_4$ solution containing 13 parts by weight of $H_2SO_4$ and 0.6 part by weight of $Al^{3+}$ ions per 100 parts by volume of the solution, for 20 seconds at 46° C. and at a voltage of 27 V. The totally applied oxide layer has a weight of 1.7 $g/m^2$. Samples of the roughened and anodically oxidized aluminum strip are coated with the following positive-working photosensitive mixture:

0.6 part by weight of the esterification product of 1 mole of 2,2'-dihydroxydinaphthyl-(1,1')-methane and 2 moles of 1,2-naphthoquinone-2-diazide-5-sulfochloride 1.0 part by weight of the 4-(2-phenyl-prop-2-yl)-phenylester of 1,2-naphthoquinone-2-diazide-4-sulfonic acid 7.5 parts by weight of a novolac resin 0.1 part by weight of crystal violet base 0.3 part by weight of 1,2-naphtoquinone-2-diazide-4-sulfochloride 90 parts by volume of ethylene glycol monoethyl ether.

The weight of the layer is approximately 2 $g/m^2$. A printing form is produced by exposing in a known manner and developing the printing form with an aqueous-alkaline solution. A printing form of this kind has an excellent water/ink balance and yields about 200,000 good quality prints.

EXAMPLE 2

The procedure of Example 1 is essentially followed; however, electrochemical roughening is performed in an aqueous solution containing 0.7 part by weight of HCl and 1.2 parts by weight of $AlCl_3.6H_2O$, per 100 parts by volume of the solution. Anodic oxidation is effected in a 12% strength aqueous $H_3PO_4$ solution at a voltage of 50 V and in an aqueous $H_2SO_4$ solution containing 15 parts by weight of $H_2SO_4$. In the printing form prepared from the plate coated with the photosensitive mixture, the water-requirement upon printing is even lower and the printing form yields a print-run which is only slightly below that obtained according to Example 1.

EXAMPLE 3

The procedure of Example 1 is essentially followed, however, roughening is performed by a multistage procedure (cf. German Patent Application No. 3,305,067, filing date Feb. 14, 1983). The first roughening stage comprising wire-brushing is followed by an abrading intermediate treatment in an aqueous NaOH solution and then by an electrochemical-roughening stage in an aqueous solution containing 1.5% of $HNO_3$ and 5% of $Al(NO_3)_3$. Anodic oxidation is effected in an 8% strength aqueous $H_3PO_4$ solution at 60° C. and in an aqueous $H_2SO_4$ solution containing 25 parts by weight of $H_2SO_4$, at 40° C. The plate coated with the photosensitive mixture has a markedly reduced halation tendency upon exposure, as compared with Example 1, and the printing form prepared from the plate possesses the properties indicated in Example 1.

EXAMPLE 4

The procedure of Example 2 is essentially followed; however, anodic oxidation is carried out using, in the first stage, an aqueous solution containing 10% of $H_3PO_4$, at 55° C., for 40 seconds and at a voltage of 60 V and, in the second stage, an aqueous solution containing 15% of $H_2SO_4$, at 45° C., for 40 seconds and at a voltage of 30 V. The plate provided with the photosensitive coating of Example 1 shows practically no dye absorption, and abrasion of the oxide layer is about 0.76 $g/m^2$.

COMPARATIVE EXAMPLE C1

The procedure of Example 1 is followed in the roughening stage; however, the two-stage anodic oxidation is carried out in accordance with the teaching of the above-cited and discussed British Patent Application No. 2,088,901, i.e., using, in the first stage, an aqueous solution containing 30% of $H_3PO_4$, at 55° C., for 240 seconds and at a voltage of 20 V and, in the second stage, an aqueous solution containing 27% of $H_3PO_4$ and 15% of $H_2SO_4$, at 45° C., for 240 seconds and at a voltage of 35 V. The plate provided with the photosensitive coating of Example 1 shows a dye adsorption which, depending on the method of measuring, is about 3 to 22 times higher than the values of Example 4, and the abrasion of the oxide layer is about 1.18 g/m$^2$.

COMPARATIVE EXAMPLE C2

In the roughening stage, the procedure of Example 1 is followed; however, the two-stage anodic oxidation is performed in accordance with the teaching of the above-cited and discussed European Pat. No. 0,007,234, i.e., using aqueous solutions which contain, in the first stage, 45% of $H_3PO_4$ and, in the second stage, 15% of $H_2SO_4$, with an alternating current at a current density of 2 A/dm$^2$ acting for 240 seconds, in each stage. The plate provided with the photosensitive coating of Example 1 exhibits a dye adsorption which, depending on the method of measuring, is about 7 to 29 times higher than the values of Example 4, and the abrasion of the oxide layer is about 2.20 g/m$^2$.

What is claimed is:

1. A process for producing an aluminum or aluminum alloy material in the form of a plate, foil or strip, comprising the step of anodically oxidizing a support material in a two-stage oxidation process comprising the steps of:

(a) first treating said support material in an aqueous electrolyte comprising from about 60 to 180 g/l of phosphoric acid, at a temperature of from about 47° to 70° C. and a voltage of from about 36 to 80 V, and (b) subsequently treating said support material in an aqueous electrolyte comprising from about 60 to 300 g/l of sulfuric acid, at a temperature of from about 30° to 65° C. and a voltage of from about 15 to 35 V.

2. A process as claimed in claim 1, wherein said first treating step comprises treating said support material in an aqueous electrolyte comprising from about 80 to 150 g/l of phosphoric acid, at a temperature of from about 50° to 65° C. and a voltage of from about 40 to 70 V.

3. A process as claimed in claim 1, wherein said second treating step comprises treating said support material in an aqueous electrolyte comprising from about 80 to 250 g/l of sulfuric acid, at a temperature of from about 40° to 60° C. and a voltage of from about 20 to 30 V.

4. A process as claimed in claim 1, wherein said aqueous electrolyte of said first treating step comprises ≦30 g/l of a component differing from said phosphoric acid.

5. A process as claimed in claim 1, wherein said aqueous electrolyte of said second treating step comprises ≦50 g/l of a component differing from said sulfuric acid.

6. A process as claimed in claim 1, comprising the further step of post-treating said anodized support material.

7. A process as claimed in claim 6, wherein said post-treating step comprises hydrophilizing.

8. A process as claimed in claim 1, comprising the further step of abrading said support material prior to said first treating step.

9. A process as claimed in claim 1, comprising the further step of chemically, electrochemically and/or mechanically roughening said support material prior to said first treating step.

10. A process as claimed in claim 9, wherein said roughening step comprises electrochemically roughening said support.

11. A process as claimed in claim 9, wherein said roughening step comprises a combination of mechanical and electrochemical roughening.

12. A process as claimed in claim 1, wherein said anodic oxidation step comprises continuously anodically oxidizing said support material.

13. A process as claimed in claim 1, wherein said anodic oxidation step comprises discontinuously anodically oxidizing said support material.

14. A process as claimed in claim 1, wherein said aqueous electrolyte of said first treating step comprises about 100 g/l of phosphoric acid at 55° C. and at a voltage of 60 V and said aqueous electrolyte of said second treating step comprises about 250 g/l of sulfuric acid at 45° C. and at a voltage of 30 V.

15. A process as claimed in claim 1, wherein said aqueous electrolyte of said first treating step comprises from about 80 to 120 g/l of phosphoric acid, at a temperature of from about 55° to 60° C. and a voltage of from about 50–60 V, and said aqueous electrolyte of said second treating step comprises from about 130 to 250 g/l of sulfuric acid, at a temperature of from about 40° to 46° C. and a voltage of from about 27 to 30 V.

16. An offset-printing plate, comprising:

an anodically oxidized support material produced by the process of claim 1; and a radiation-sensitive coating on said support material.

17. A printing plate as claimed in claim 16 wherein said support material comprises an aluminum oxide layer having a weight between about 0.5 and 10 g/m$^2$.

* * * * *